United States Patent [19]

Short, Jr.

[11] Patent Number: 4,538,690

[45] Date of Patent: Sep. 3, 1985

[54] PDC CUTTER AND BIT

[75] Inventor: Lot W. Short, Jr., Dallas, Tex.

[73] Assignee: NL Industries, Inc., New York, N.Y.

[21] Appl. No.: 468,668

[22] Filed: Feb. 22, 1983

[51] Int. Cl.[3] ..... E21B 10/46

[52] U.S. Cl. ..... 175/329; 175/410

[58] Field of Search ..... 175/329–330, 175/410, 374, 379; 76/101 A

[56] References Cited

U.S. PATENT DOCUMENTS

| | | | |
|---|---|---|---|
| 1,025,735 | 5/1912 | Bosredon | 76/101 A |
| 1,835,701 | 12/1931 | Edmunds | 76/101 A X |
| 1,859,717 | 5/1932 | Rutrle | 175/410 |
| 1,882,268 | 10/1932 | Appleman | 175/421 |
| 2,072,470 | 3/1937 | Thompson | 175/413 X |
| 2,998,088 | 8/1961 | Pennington | 175/329 |
| 3,239,275 | 3/1966 | Belugou | 175/410 |
| 3,882,749 | 5/1975 | Tourek | 175/379 X |
| 4,108,260 | 8/1978 | Bozarth | 175/410 X |
| 4,199,035 | 4/1980 | Thompson | 175/410 |
| 4,244,432 | 1/1981 | Rowley et al. | 175/329 |
| 4,334,585 | 6/1982 | Upton | 175/329 |
| 4,350,215 | 9/1982 | Radtke | 175/329 |

FOREIGN PATENT DOCUMENTS

| | | |
|---|---|---|
| 1228941 | 7/1963 | France . |
| 330433 | 6/1930 | United Kingdom . |
| 2022476 | 12/1979 | United Kingdom . |
| 2086451 | 5/1982 | United Kingdom . |
| 2095724 | 10/1982 | United Kingdom . |

OTHER PUBLICATIONS

J. D. Barr, Optimisation of Radial Distribution of Stratapax Cutter in Rock Drilling Bits, Feb. 1, 1980, see FIG. 5.

1980–1981 Composite Catalog, p. 5169.

David Hall, Megadiamond Announces a Unique Service, Oct. 6, 1981.

Cover of Drilling Magazine, Jan. 1983.

1938 Composite Catalog, p. 961.

1938 Composite Catalog, B. K. Appleman of Beaumont, Texas.

1939 Composite Catalog, p. 366.

Excerpt from J. E. Brantley, *History of Oil Well Drilling*, Gulf Publishing Co., Houston, Texas.

*Primary Examiner*—Stephen J. Novosad

*Assistant Examiner*—Thuy M. Bui

*Attorney, Agent, or Firm*—Browning, Bushman, Zamecki & Anderson

[57] ABSTRACT

The invention comprises a drag-type drill bit and a cutting member therefor. Each of the cutting members comprises a stud having a shank adjacent one end mounted in a respective bore in the bit body and a head adjacent the opposite end projecting outwardly from the bit body. The head has a lip formation adjacent the juncture of the head and shank. The lip extends laterally outwardly with respect to the shank to overly the outer surface of the bit body adjacent the respective bore. The cutting face is concave, presenting a plurality of different back rake angles, which angles increase with distance from the lip formation.

28 Claims, 6 Drawing Figures

FIG. 1
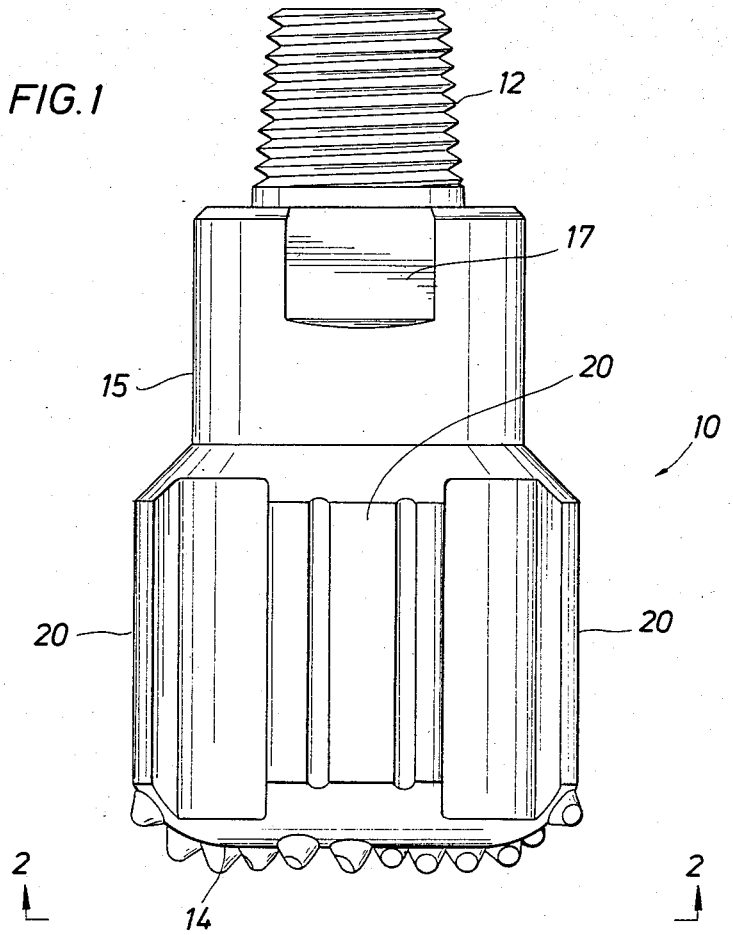
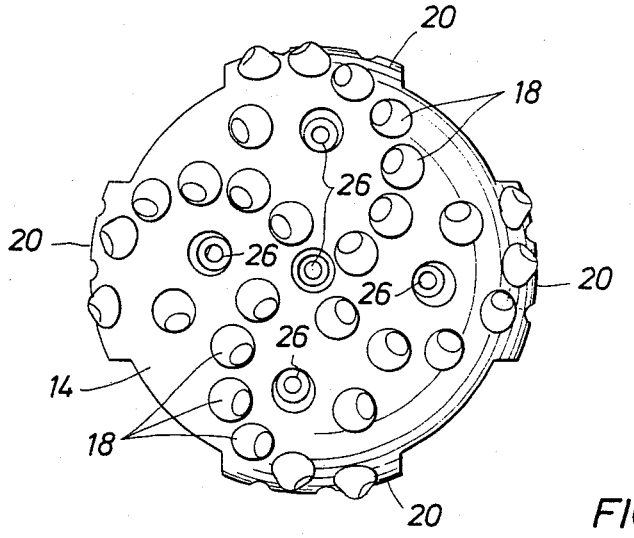
FIG. 2

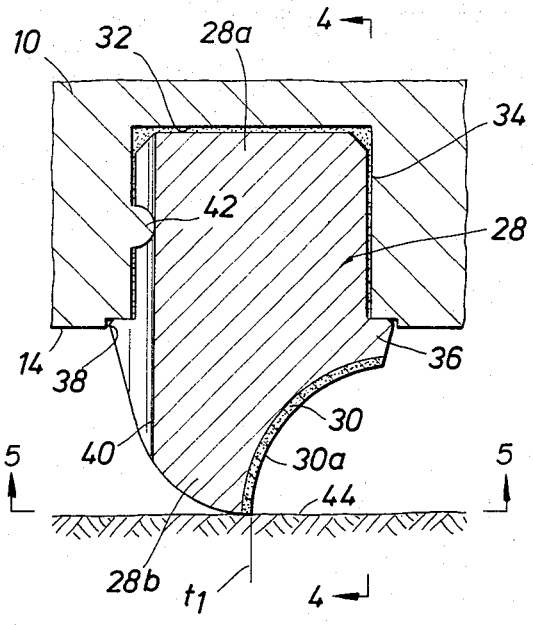
FIG. 3
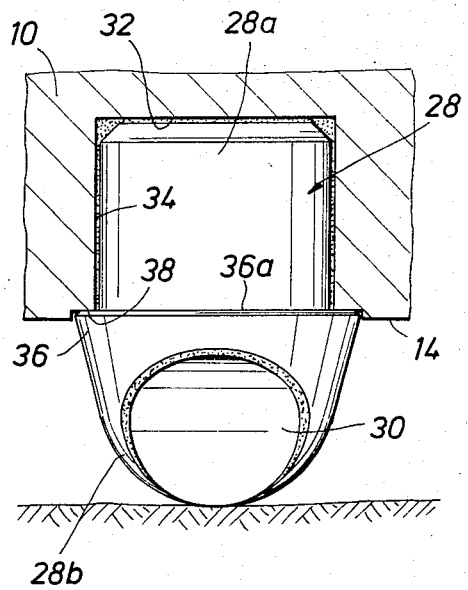
FIG. 4
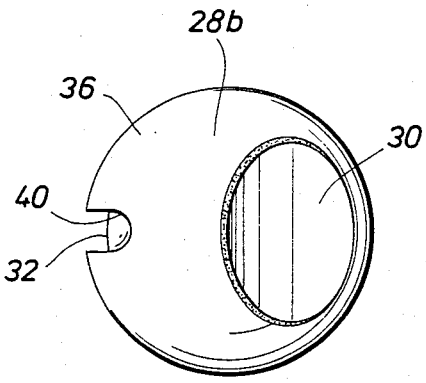
FIG. 5
FIG. 6
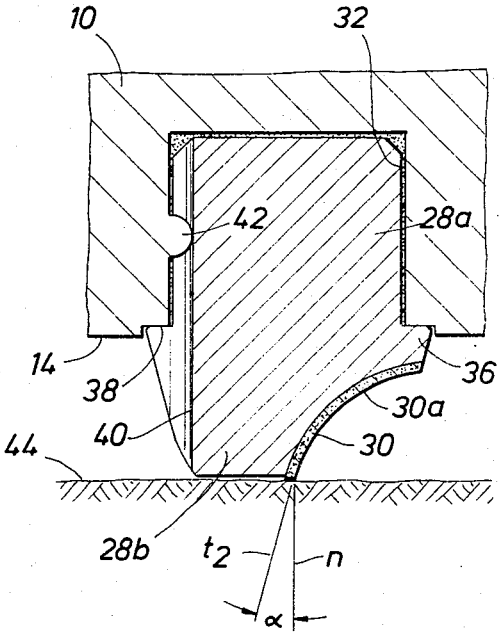

PDC CUTTER AND BIT

BACKGROUND OF THE INVENTION

The present invention pertains to drag-type drill bits and, more particularly, to the type of bit in which a plurality of cutting members are mounted on a bit body. Typically, each such cutting member comprises an elongate or stud-like body, e.g. of sintered tungsten carbide, carrying a layer of super-hard materials, e.g. polycrystalline diamond, which defines the actual cutting face. Such use of layers of different materials renders the cutting members self-sharpening in the sense that, in use, the tungsten carbide material will tend to wear at more easily than the polycrystalline diamond material. This causes the development of a small step or clearance at the juncture of the two materials so that the earth formation continues to be contacted and cut substantially only by the edge of the diamond layer, the tungsten carbide substrate having little or no high pressure contact with the earth formation. Because the diamond layer is relatively thin, the edge thus maintained is correspondingly sharp.

The bit bodies in which these cutting members are mounted may generally be divided into two types: bodies formed of steel or similar ductile metallic material, and bodies formed of tungsten carbide matrix material. With steel body bits, it is relatively easy to mount the cutting members in the bit body by interference fitting techniques, e.g. press fitting or shrink fitting. In some instances, tungsten carbide matrix body bits are preferred over steel body bits because of their hardness. However, although harder than steel and similar metals, tungsten carbide matrix is also more brittle, rendering interference fitting techniques much more difficult. Accordingly, in matrix body bits, the cutting members are often brazed into place.

This brazing, in turn, introduces a new problem in use. As fluid circulates about the bit during drilling, it tends to attack and wear the areas of least resistance. Thus, where cutting members have been brazed onto a bit body, the relatively soft braze material located between the cutting members and the bit body may be eroded away, and the cutting members may be lost. Loss of even a single cutting member in this manner drastically increases the load on neighboring cutting members, and may result in catastrophic failure of the bit as a whole.

Another problem commonly associated with the use of such bits is that of selecting a suitable back rack angle for a particular drilling job. It has been found that the effectiveness of the cutting members and the bit in general can be improved by proper arrangement of the cutting members and, more specifically, their cutting faces, with respect to the body of the drill bit, and thus to the earth formation being cut. Conventional cutting faces are typically planar (although outwardly convex cutting faces are known). The cutting members can be mounted on the bit so that such planar cutting faces have some degree of side rake and/or back rake. Any given drill bit is designed to cut the earth formation to a desired three-dimensional "profile" which generally parallels the configuration of the operating end of the drill bit. "Side rake" can be technically defined as the complement of the angle between (1) a given cutting face and (2) a vector in the direction of motion of said cutting face in use, the angle being measured in a plane tangential to the earth formation profile at the closest adjacent point. As a practical matter, a cutting face has some degree of side rake if it is not aligned in a strictly radial direction with respect to the end face of the bit as a whole, but rather, has both radial and tangential components of direction. "Back rake" can be technically defined as the angle between (1) the cutting face and (2) the normal to the earth formation profile at the closest adjacent point, measured in a plane containing the direction of motion of the cutting member, e.g. a plane perpendicular to both the cutting face and the adjacent portion of the earth formation profile (assuming a side rake angle of 0°). If the aforementioned normal falls within the cutting member, then the back rake is negative; if the normal falls outside the cutting member, the back rake is positive. As a practical matter, back rake can be considered a canting of the cutting face with respect to the adjacent portion of the earth formation profile, i.e. "local profile," with the rake being negative if the cutting edge is the trailing edge of the overall cutting face in use and positive if the cutting edge is the leading edge. Substantial positive back rake angles have seldom, if ever, been used. Thus, in the terminology of the art, a negative back rake angle is often referred to as relatively "large" or "small" in the sense of its absolute value. For example, a back rake angle of −20° would be considered larger than a zero back rake angle, and a back rake angle of −30° would be considered still larger.

Proper selection of the back rake angle is particularly important for most efficient drilling in a given type of earth formation. In soft formations, relatively small cutting forces may be used so that cutter damage problems are minimized. It thus becomes possible, and indeeded preferably, to utilize a very slight negative rake angle, a zero rake angle or even a slight positive rake angle, since such angles permit fast drilling and optimize specific energy. However, in hard rock, it is necessary to use a significant negative rake angle, in order to avoid excessive wear in the form of breakage or chipping of the cutting members due to the highter cutting forces which become necessary.

Problems arise in drilling through stratified formations in which the different strata vary in hardness, as well as in drilling through formations which, while substantially comprised of relatively soft material, contain "stringers" of hard rock. In the past, one of the most conservative approaches to this problem was to utilize a relatively large negative back rake angle, e.g. −20° for the entire drilling operation. This would ensure that, if or when hard rock was encountered, it would be drilled without damage to the cutting members. However, this approach is unacceptable, particularly where it is known that a substantial portion, specifically the uppermost portion, of the formation to be drilled is soft, because the substantial negative back rake angle unduly limits the speed of drilling in the soft formation.

Another approach, applicable where the formation is stratified, is to utilize a bit whose cutting members have relatively small or zero back rake angles to drill through the soft formation and then change bits and drill through the hard formation with a bit whose cutting members have substantial negative back rake angles, e.g. −20° or more. This approach is unsatisfactory because of the time and expense of a special "trip" of the drill string for the purpose of changing bits.

If it is believed that the formation is uniformly soft, a somewhat daring approach is to utilize the relatively small back rake angles in order to maximize the penetration rate. However, if a hard stringer is encountered, catastrophic failures can result. For example, severe chipping of only a single cutting member increases the load on neighboring cutting members and shortens their life resulting in a premature "ring out," i.e. a condition in which the bit is effectively inoperative.

Still another problem associated with the general type of bit and cutting member described above, is that chips of the formation material being drilled may build up ahead of the cutting faces of the cutting members.

SUMMARY OF THE INVENTION

The present invention pertains to a type of cutting member which addresses the various problems discussed above. The invention also comprises a drill bit including such cutting members, and which bit may be further designed to cooperate with the cutting members in attacking those problems. A bit according to the present invention includes a bit body and a plurality of cutting members mounted thereon. Each of the cutting members comprises an elongate or stud-like body having a shank or mounting portion adjacent one end mounted in a respective bore in the bit body and an operating portion or head adjacent the opposite end projecting outwardly from the bit body. The elongate body and, more specifically, the operating portion thereof, has a lip formation adjacent the juncture of the mounting and operating portions. The lip formation is on the operating portion and extends laterally outwardly with respect to the mounting portion to overly the outer surface of the bit body adjacent the respective bore. Thus, the lip formation serves as a shield over the interface between the mounting portion and the respective bore in the bit body, protecting said interface from erosion by the drilling fluid and various materials carried thereby. Such shielding is particularly important where the cutting member is brazed into the bit body, as the braze material is relatively vulnerable to such erosion.

In preferred forms of the invention, the lip formation is in the form of a skirt which defines an axially facing shoulder for abutment with the outer surface of the bit body around the respective bore, the operating portion of the elongate body of the cutting member being flared radially outwardly to the outer edge of said shoulder. By virtue of such flaring, the lip formation forms an obtuse angle with the surface of the bit body laterally outwardly of the lip formation. This helps to reduce turbulence in the area and further inhibits erosion of the bit body and cutter.

The cutting faces of the cutting members on a bit according to the present invention have back rake angles which become less negative with distance from the bit body, i.e. with distance from the lip formation. The terminology "less negative" and "more negative" is not meant to imply that all the back rake angles defined by the cutting faces are negative. Indeed, one of the advantages of the invention is that it makes the use of zero or slightly positive angles more feasible. Thus, the term "more negative" is simply intended to mean that the values of the angles vary in the negative direction (with distance from the earth formation profile) whether beginning with a positive, zero or negative value. Conversely, "less negative" will mean that the angles vary in the positive direction (with distance from the bit body).

Specifically, each individual cutting face is preferably curved, concave outwardly, so that it has a continuously changing back rake angle from its innermost to its outermost extremity. As the bit begins to operate, the outermost edges of the cutting faces present relatively small back rake angles to the formation, e.g. about 0°. Thus, assuming the bit was started in a relatively soft formation, it will be able to drill rapidly. If a hard stringer is encountered, or if the bit reaches the end of a soft stratum and begins to enter a hard stratum, the cutting members will quickly chip or break away so that more and more negative rake angles will be presented to the earth formation. When the cutting members have thus chipped away to a point where their back rack angles are suitable for the type of formation, such excessive wear or chipping will stop, and the bit can then continue drilling the formation essentially as if the back rake angle had initially been tailored to the particular type of rock encountered. Thus, the system may be considered self-adjusting in the negative direction. If, subsequently, soft formation is again encountered, the cutters can still continue drilling acceptably, albeit at a slower rate of speed than was possible in drilling the first soft formation.

Another advantage of the concave cutting faces is that, in the event of severe wear, the extreme negative back rake angle which will be presented to the formation will effectively stop bit penetration in time to prevent the formation of junk by massive destruction of the bit.

The concave cutting faces also have a "chip breaker" effect. Any chip which begins to form ahead of such a concave cutting face will be forced to follow its curvature and will thus break off and fall away, rather than building up ahead of the cutting face. This chip breaker effect is enhanced where the cutting face, while curved in planes in which back rake angle can be measured, is substantially straight in planes normal to those in which back rake angle can be measured, so that there will be no tendency for the chip to be forced laterally inwardly with respect to the cutting face. For example, each cutting face may define a portion of a cylinder.

Other features of the improved cutter or cutting member according to the present invention are directed toward making it applicable to existing bit body styles with minimal modification or redesign required.

Accordingly, it is a principal object of the present invention to provide an improved drag-type drill bit.

Another object of the present invention is to provide an improved cutting member for such a bit.

Still another object of the present invention is to provide such a cutting member having a lip formation for shielding the interface between the cutting member and the bit body.

A further object of the present invention is to provide such a cutting member having an outwardly concave cutting face of the self-sharpening type.

Still other objects, features and advantages of the present invention will be made apparent by the following detailed description, the drawings and the claims.

BRIEF DESCRIPTION OF THE DRAWINGS

FIG. 1 is a side elevational view of a drill bit according to the present invention.

FIG. 2 is a bottom plan view of the bit of FIG. 1.

FIG. 3 is an enlarged detailed view showing one of the cutting members in side elevation and surrounding portions of the bit body in cross section, and taken in a plane in which back rake angle can be measured.

FIG. 4 is a view taken on the line 4—4 of FIG. 3.

FIG. 5 is a view taken on the line 5—5 of FIG. 3.

FIG. 6 is a view similar to that of FIG. 3 showing the cutting member after it has been chipped or worn to present a different back rake angle to the earth formation.

DETAILED DESCRIPTION OF THE PREFERRED EMBODIMENT

FIGS. 1 and 2 depict a drill bit according to the present invention. As used herein, "drill bit" will be broadly construed as encompassing both full bore bits and coring bits. The bit body, generally designated by the numeral 10 is comprised of a tungsten carbide matrix material, although various aspects of the present invention are also applicable to bits formed of other materials such as steel. Bit body 10 has a threaded pin 12 at one end for connection to the drill string, and an operating end face 14 at the opposite end. The "operating end face," as used herein, includes not only the actual end or axially facing portion shown in FIG. 2, but contiguous areas extending partially up along the lower sides of the bit, i.e. the entire lower portion of the bit which carries the operative cutting members described hereinbelow. Just above the operating end face 14, bit 10 has a gauge or stabilizer section, including stabilizer ribs or kickers 20. Ribs 20, which may be provided with buttons of hard material such as tungsten carbide (not shown) contact the walls of the borehole which has been drilled by operating end face 14 to centralize and stabilize the bit and help control its vibration. Just above the gauge section is a smaller diameter section 15 having wrench flats 17 engaged while making up or breaking out the bit from the drill string. Operating end face 14 carries a plurality of cutting members or cutters 18. Referring to FIG. 2, the underside of the bit body 10 has a number of circulation ports or nozzle 26 through which drilling fluid is circulated in use.

Referring now to FIGS. 3–5, one of the cutting members and its relation to the adjacent portion of the bit body is shown in greater detail. The cutting member is comprised of an elongate or stud-like body 28, formed of sintered tungsten carbide, and a layer 30 of superhard material, specifically polycrystalline diamond. As used herein, "superhard" will refer to materials significantly harder than silicon carbide, which has a Knoop hardness of 2470, i.e. to materials having a Knoop hardness greater than or equal to 2500. Body 28 includes an innermost shank or mounting portion **28*a* adjacent one end and a head or operating portion 28*b* adjacent the opposite end. Shank 28*a* is brazed into a bore 32 in bit body 10, the braze material being indicated at 34. When shank 28*a* is thus properly mounted, head 28*b* projects outwardly from the operating end face 14 of the bit body 10. Adjacent the juncture of mounting and operating portions 28*a* and 28*b*, operating portion 28*b* of the elongate body 28 has a lip or skirt formation 36 extending laterally outwardly with respect to shank 28*a* so as to overly the outer surface of the bit body around bore 32. More specifically, lip 36 defines a shoulder 36*a* immediately adjacent the juncture of portions 28*a* and 28*b* facing axially toward the inner end or shank end of body 28. Head or operating portion 28*b* is flared radially outwardly to the outer extremity of shoulder 36*a* as shown. The outer surface or, more specifically, the operating end face 14, of bit 10 may be provided with a shallow recess 38, as shown, for receipt of lip 36**, although this is not strictly necessary.

It can be seen that lip 36 overlies the thin cylinder of braze material 34 and shields it from attack by the drilling fluid and entrained abrasives in use. This is of particular value in matrix body bits, wherein it is difficult to mount the cutting members with interference fits, and the braze material which may be used instead represents a relatively vulnerable area. As shown in FIGS. 3 and 5, body 28 has a lengthwise slot 40 which receives a detent 42 projecting inwardly from bore 32 in the bit body. The mating of slot 40 and detent 42 serves to index the cutting member to the proper orientation on the bit body, more specifically, so that layer 30 of polycrystalline diamond will be located on the leading side of the cutting member. Referring still to FIG. 5, it can be seen that lip 36 extends around the entire circumference of body 28, except in the area of slot 40. This break in lip 36 does not represent a substantial threat to the braze material 34 from the drilling fluid for two reasons: in the first place, slot 40 is very small and is located on the trailing side of the cutting member; secondly, projection 42 is so tightly received in slot 40 that it effectively forms a seal against ingress of the drilling fluid.

Because of the outward flaring of head **28*b* to the outer extremity of shoulder 36*a*, as described above, to form lip 36 generally in the form of a tapered skirt, that skirt forms, with the adjacent outer surface 14 of the bit body, an obtuse angle (neglecting the relatively thin side wall of recess 38**). This helps to reduce turbulence in the drilling fluid around the cutting member, which in turn helps to retard erosion of both the bit body and the cutting member itself in that area.

As previously mentioned, head **28*b* of body 28 carries a relatively thin layer 30 of polycrystalline diamond which defines the cutting face 30*a* of the cutting member. Layer 30, the underlying portion of head 28*b*, and the cutting face 30*a* defined by layer 30 are all inwardly concave in planes in which their back rake angle may be measured, e.g. the plane of FIG. 3. Thus, cutting face 30*a* is a surface having a number of different back rake angles, which angles become more negative with distance from the profile of the earth formation 44, i.e. the angles become more negative from the outermost to the innermost edges of cutting face 30*a*, or less negative with distance from lip formation 36. (As used herein "distance" from the formation profile is measured from the closest point on that profile.) For example, as shown in FIG. 3, the original outermost edge of face 30*a* forms the initial cutting edge in use. It can be seen that a tangent $t_1$ to surface 30*a* at its point of contact with the earth formation 44 is substantially coincident with a normal to that surface at the same point. Thus, the back rake angle at the original outermost edge or cutting edge of surface 30*a*** is 0°.

FIG. 6 illustrates the same cutting member after considerable wear. The step formed between head **28*b* of body 28 and layer 30 by the self-sharpening effect is shown exaggerated. It can be seen that, after such wear, the tangent $t_2$ to the cutting face 30*a* at its point of contact with the earth formation 44 forms an angle $\alpha$ with the normal n to the profile of the earth formation at that point of contact. It can also be seen that a projection of the normal n would fall within the cutting member 28, 30**. Thus, a significant back rake angle is now presented to the earth formation, and because the normal n falls within the cutting member, that angle is negative. More specifically, the back rake angle $\alpha$ is about $-10°$ as shown.

In use, relatively soft formations may often be drilled first, with harder rock being encountered in lower strata and/or small "stringers." As drilling in such soft formation begins, the cutting member is presented to the earth formation in the configuration shown in FIG. 3. Thus, the operative portion of face 30*a* has a back rake angle of approximately 0°. With such a back rake angle, the bit can drill relatively rapidly through the soft formation without substantial or excessive wear of the cutting members. If and when harder rock is encountered, the cutting member, including both the super-hard layer 30 and the body 28, will wear extremely rapidly until the back rake angle presented to the earth formation is a suitable one for the kind of rock being drilled. For example, the apparatus may rapidly chip away until it achieves the configuration shown in FIG. 6, at which time the wear rate will subside to an acceptable level for the particular type of rock. Thus, the cutting member, with its varying back rake angles, is self-adjusting in the negative direction.

Having reached a configuration such as that shown in FIG. 6 suitable for the local formation, the cutting member and other cutting members on the bit, which will have worn in a similar manner, will then continue drilling the new hard rock without further excessive wear or damage. If, subsequently, soft formation is again encountered, the cutting members, even though worn to the configuration of FIG. 6 for example, can still continue drilling. Although they will not be able to drill at the fast rate permitted by the original configuration of FIG. 3, they will at least have drilled the uppermost part of the formation at the maximum possible rate, and can still continue drilling the lower portion at a slower but nevertheless acceptable rate.

Thus, a bit according to the present invention will tend to optimize both drilling rate and bit life. The overall time for drilling a given well will be much less than if cutters with substantial negative back rake angles had been used continuously. At the same time, there will be no undue expense due to a special trip to change from one drill bit to another as different types of formations are encountered. Likewise, there will be no danger of catastrophic failure as if cutters with small or zero rake angles had been used throughout. It is noted, in particular, that if extreme wear is experienced, the surface 30*a* of the cutting member illustrated and the surfaces of the other similar cutting members on the bit will present such large negative back rake angles to the formation that bit penetration will be effectively stopped in time to prevent the formation of junk by massive damage.

Another advantage of the curved configuration of cutting face 30*a* is that it has a "chip breaker" effect. Briefly, if a chip of the earth formation begins to build up in front of cutting face 30*a*, the curvature of that face will tend to direct the forming chip up and over the cutting face, so that it breaks off and falls away, rather than accumulating on the leading side of the cutting face. It has been noted that face 30*a* is curved in planes, such as that of FIGS. 3 and 6, in which back rake angle can be measured. However, face 30*a* is substantially straight in planes normal to those in which back rake angle can be measured. More specifically, face 30*a* defines a portion of a cylinder. This is believed to enhance the aforementioned chip breaker effect, as compared for example to a configuration which is concave in normal planes, by eliminating any tendency to guide or direct a forming chip laterally inwardly with respect to the cutting face.

One objective of the present invention is to permit existing bit designs to be adapted for use of cutters according to the present invention with a minimum of modification. The invention has been illustrated in connection with a typical bit in which the bores 32 are formed substantially perpendicular to the local bit profile. In order to provide for a back rake angle of 0° at the original or outermost edge of face 30*a*, given such orientation, face 30*a* is formed so that a tangent to face 30*a* at its outermost edge lies in a plane passing longitudinally through body 28. Further, for simplicity of manufacture, that plane contains the centerline of body 28, with the remainder of face 30*a* being laterally offset from the centerline as shown in FIG. 3. It should be understood, however, that the orientation of the cutting face with respect to the body on which it is carried can be changed to adapt the invention to other types of bits, in which the cutting members are not mounted at right angles to the local bit profile, and/or to provide for initial back rake angles of other than 0°.

Numerous other modifications of the preferred embodiment disclosed above will suggest themselves to those of skill in the art, and are within the spirit of the invention. For example, the exemplary embodiment shows the polycrystalline diamond layer applied directly to the stud-like mounting body. The diamond layer could, alternatively, be mounted on the stud via an intermediate disc-like carrier of tungsten carbide, in a manner well known in the art. It is thus intended that the scope of the invention be limited only by the claims which follow.

What is claimed is:

1. A cutting member for mounting on a drill bit comprising:

an elongate body comprised of sintered tungsten carbide, said elongate body having a mounting portion adjacent one end, said mounting portion being adapted to be received in a bore in a drill bit body, and an operating portion adjacent the opposite end, said operating portion being adapted to project outwardly from said drill bit body when said mounting portion is so received in such bore, and said operating portion having a lip formation adjacent the juncture of said mounting and operating portions, said lip formation extending laterally outwardly with respect to said mounting portion whereby it may overly the outer surface of such bit body adjacent such bore when said mounting portion is so received therein, and said lip formation defining a shoulder facing axially toward said one end of said elongate body, and wherein said operating portion is flared radially outwardly to the outer edge of said shoulder.

2. A cutting member according to claim 1, wherein said shoulder extends around the major portion of the circumference of said elongate body.

3. A cutting member according to claim 1 wherein said operating portion has a cutting face thereon, said cutting face having a plurality of back rake angles becoming less negative with distance from said lip formation.

4. A cutting member according to claim 3 being a self-sharpening type cutting member.

5. A cutting member according to claim 4 wherein said cutting face is defined by a layer of material carried on said elongate body and substantially harder than the material of said elongate body.

6. A cutting member according to claim 5 wherein said layer defining said cutting face comprises polycrystalline diamond.

7. A cutting member according to claim 5 wherein said cutting face is curved, concave outwardly.

8. A cutting member according to claim 7 wherein said cutting face has an original cutting edge disposed axially outermost and generally intersecting the centerline of said elongate body, the remainder of said cutting face being laterally offset from said centerline.

9. A cutting member according to claim 7 wherein said cutting face is curved in planes in which back rake angle can be measured but substantially straight in planes normal to those in which back rake angle can be measured.

10. A cutting member according to claim 9 wherein said cutting face defines a portion of a cylinder.

11. A cutting member according to claim 10 wherein said original cutting edge has a back rake angle of approximately 0°.

12. A cutting member according to claim 11 wherein said elongate body is comprised of sintered tungsten carbide, and said superhard material comprises polycrystalline diamond.

13. A cutting member according to claim 12 wherein said cutting face is curved, concave outwardly.

14. A cutting member according to claim 13 wherein said cutting face is curved in planes in which back rake angle can be measured, but is substantially straight in planes normal to those in which back rake angle can be measured.

15. A cutting member according to claim 14 wherein said cutting face defines a portion of a cylinder.

16. A cutting member according to claim 12 wherein said original cutting edge generally intersects the centerline of said elongate body, the remainder of said cutting face being laterally offset from said centerline.

17. A self-sharpening cutting member for mounting on a drag-type drill bit comprising:

an elongate body and a layer of superhard material carried on said body and defining a cutting face adjacent one end of said body, said cutting face having an original cutting edge disposed axially outermost and having a plurality of back rake angles becoming more negative from said original cutting edge axially inwardly, a tangent to said cutting face at said original cutting edge lying in a plane passing longitudinally through said elongate body.

18. A cutting member for mounting on a drill bit comprising:

an elongate body comprised of sintered tungsten carbide, said elongate body having a stud-like mounting portion adjacent one end and an operating portion adjacent the opposite end, said body having a shoulder adjacent the juncture of said mounting and operating portions and facing axially toward said one end, and said operating portion flaring radially outwardly to the outer edge of said shoulder.

19. A cutting member according to claim 18 wherein said shoulder extends around the major portion of the circumference of said elongate body.

20. A cutting member according to claim 19 further comprising a layer of superhard material carried on said operating portion and defining a concave cutting face.

21. A drag-type drill bit comprising:

a bit body;

a plurality of cutting members mounted on said bit body, each of said cutting members comprising an elongate body comprised of sintered tungsten carbide, said elongate body having a mounting portion adjacent one end brazed into a respective bore in said bit body, and an operating portion adjacent the opposite end projecting outwardly from said bit body, said operating portion having a lip formation adjacent the juncture of said mounting and operating portions, said lip formation extending laterally outwardly with respect to said mounting portion and overlying the outer surface of said bit body adjacent the respective bore and thereby shielding the brazed interface between said mounting body of said bit body, said lip formation forming an obtuse angle with the surface of said bit body outwardly of said lip formation.

22. A bit according to claim 21 wherein said elongate body has an indexing formation of limited circumferential extent, and said lip formation extends around the entire circumference of said elongate body except in the area of said indexing formation.

23. A bit according to claim 22 wherein said bit body has, associated with each of said bores, an indexing formation sealingly engaging the indexing formation of the respective elongate body.

24. A bit according to claim 23 wherein said bit body comprises a tungsten carbide matrix material.

25. A bit according to claim 24 wherein the operating portion of each of said elongate bodies carries a layer of superhard material defining a concave cutting face.

26. A bit according to claim 21 wherein said operating portions of said elongated bodies have cutting faces having back rake angles which become less and less negative with distance from said bit body.

27. A bit according to claim 26 wherein each of said cutting members further comprises a layer of superhard material carried by said operating portion and defining said cutting face, said cutting face being concave outwardly.

28. A bit according to claim 21 wherein the outer surface of said bit body has a respective counterbore about each of said bores receiving the respective one of said lip formations.

* * * * *

UNITED STATES PATENT AND TRADEMARK OFFICE

CERTIFICATE OF CORRECTION

PATENT NO. : 4,538,690

DATED : September 3, 1985

INVENTOR(S) : Lot W. Short, Jr.

It is certified that error appears in the above—identified patent and that said Letters Patent is hereby corrected as shown below:

In Column 10, line 28, delete "of" and insert therefor --and--.

In Column 10, line 46, delete "elongated" and insert therefor --elongate--.

Signed and Sealed this

*Twenty-sixth* Day of *August 1986*

[SEAL]

*Attest:*

DONALD J. QUIGG

*Attesting Officer*

*Commissioner of Patents and Trademarks*